US006421982B1

(12) United States Patent
Eichenberger

(10) Patent No.: US 6,421,982 B1
(45) Date of Patent: Jul. 23, 2002

(54) APPARATUS FOR FILLING IN CONTAINERS WITH DISCRETE ARTICLES

(75) Inventor: Martin Eichenberger, Queensland (AU)

(73) Assignee: Bosspak PTY LTD (AU)

( * ) Notice: Subject to any disclaimer, the term of this patent is extended or adjusted under 35 U.S.C. 154(b) by 0 days.

(21) Appl. No.: 09/419,495

(22) Filed: Oct. 18, 1999

(30) Foreign Application Priority Data

Oct. 19, 1998 (AU) ..... PP6564

(51) Int. Cl.[7] ..... B65B 1/04

(52) U.S. Cl. ..... 53/253; 53/244; 53/253; 53/503

(58) Field of Search ..... 53/235, 250, 244, 53/253, 503

(56) References Cited

U.S. PATENT DOCUMENTS 5,463,839 A * 11/1995 Stange et al.
5,596,865 A * 1/1997 Kramer
5,638,657 A * 6/1997 Archer et al.
5,713,180 A * 2/1998 Lewis
5,762,116 A 6/1998 Moore
6,185,901 B1 * 2/2001 Aylward

FOREIGN PATENT DOCUMENTS

DE 29 18 794 1/1980
DE 29 44 494 5/1981

* cited by examiner

*Primary Examiner*—Eugene Kim
(74) *Attorney, Agent, or Firm*—Hoffman, Wasson & Gitler PC

(57) ABSTRACT

A container filling apparatus for filling containers with discrete articles is disclosed. The apparatus has a container conveyor for transporting containers to and from the apparatus and a rotatable filling head adjacent the conveyor. The head has a plurality of circumferentially spaced metering stations for metering and dispensing a stream of a predetermined number of articles into a container. A container carousel with a plurality of container receiving zones is mounted for rotation with the head and the containers are filled as the head and the carousel rotate in synchronism.

18 Claims, 8 Drawing Sheets

APPARATUS FOR FILLING IN CONTAINERS WITH DISCRETE ARTICLES

TECHNICAL FIELD

This invention relates to an apparatus for filling containers with discrete articles. In particular, the invention concerns an apparatus for filling containers with a predetermined number of pills or tablets.

The invention will be described with reference to an apparatus for filling containers with pills or tablets. It should be appreciated that this description is given by way of example only and that the apparatus of the invention may also be used for filling containers with discrete articles other than pills or tablets.

BACKGROUND ART

One known apparatus for filling containers with a predetermined number of pills or tablets has a tablet hopper into which a quantity of tablets to be deposited into containers may be placed. Vibrating trays are located downstream of the hopper and the hopper deposits tablets onto the trays. The trays have a downstream end located at a height less than the upstream end of the trays and each tray has a plurality of longitudinally extending channels. When the trays vibrate the tablets accumulate into a plurality of discrete rows and are conveyed towards the downstream end of the trays. The rows of tablets are combined into streams above a container transporting conveyor which transports a line of empty containers transversely of the apparatus and below the streams and transports filled containers transversely of the apparatus and away from the streams of tablets. The conveyor has gates which may inhibit the passage of the containers whilst they are being filled. A counting mechanism is associated with each of the rows which ensures that only a desired number of tablets are deposited into the containers.

This prior filling apparatus is slow in its operation because typically only two containers may be filled at any one time. In addition, the containers must be held stationary during filling and this further slows up the operation of the apparatus.

DISCLOSURE OF INVENTION

It is an object of the present invention to provide a container filling apparatus which at least minimises the disadvantages of the prior apparatus described above.

According to one aspect of the invention there is provided an apparatus for filling containers with a predetermined number of discrete articles, the apparatus having a container conveyor for transporting containers to be filled to the apparatus and for transporting filled containers from the apparatus, a rotatable filling head positioned adjacent the container conveyor the filling head having a plurality of circumferentially spaced metering stations each for metering and dispensing a stream of a predetermined number of discrete articles into a container, a container carousel having a plurality of container receiving zones and mounted for rotation with the head, whereby a plurality of containers are filled by the head as the carousel moves the containers in synchronism with the head and filled containers are presented to the conveyor by the carousel and conveyed away from the filling head.

A drive may be present for rotating the filling head. The apparatus may include a shaft to which the head is mounted for rotation.

The filling head has a plurality of circumferentially spaced metering stations each for dispensing tablets whilst the head rotates and for counting the number of tablets as they are dispensed so that a predetermined number of tablets may be dispensed into a plurality of container during rotation of the head. Once the desired number of tablets have dispensed into the container by a particular metering station, the station functions to prevent further tablets from being dispensed into that container.

The metering stations may have a rotatable sorting wheel for picking up tablets from a supply of tablets within the station and for orienting the tablets for dispensing the tablets in a continuous stream. The metering station may have a sensor for detecting tablets in the stream and for allowing the tablets to be counted. A gate assembly may be present for inhibiting the dispensing of tablets from a metering station once a predetermined count has been achieved. Preferably, when the dispensing action nears completion and almost the desired number of tablets have been dispensed into a container, the rotation of the wheel is slowed down and when the desired count is reached the rotation of the wheel is stopped.

The gate assembly may include a moveable gate member which may be moved into and out of the stream of tablets in a metering station. The gate member may be moved in any suitable way. For example, each gate may be operated by a pneumatic cylinder assembly.

The apparatus has a platform on which containers being filled may be supported. The head is moveable relatively towards and away from the platform so that containers of a variety of sizes may be filled. Preferably it is the head which is moved and the platform remains still.

The carousel receives containers from the conveyor and moves the containers over the platform as the head rotates. As the head is moved vertically to adjust the apparatus for use with different size containers, the carousel moves with the head. The carousel has a plurality of container receiving zones and the number of zones corresponds to the number of fillings stations.

The apparatus may have an outfeed carousel which picks up filled containers and transports them to the conveyor. The outfeed carousel is mounted for vertical movement with the filling head.

The apparatus may have an infeed carousel which picks up containers to be filled and transports them from the conveyor and presents the empty containers to the container carousel. The infeed carousel may be mounted for vertical movement with the filling head.

The conveyor is preferably located to one side of the apparatus. Any suitable conveyor such as a slat conveyor or belt conveyor may be used.

The apparatus may include a tablet elevator located to one side thereof. The elevator may have a bin mounted for movement between a lowered filling position and a raised dispensing position. In the dispensing position, tablets may flow from the bin and into the metering stations as the filling head is caused to rotate.

BRIEF DESCRIPTION OF DRAWINGS

A particular preferred embodiment of the invention will now be described by way of example with reference to the drawings in which.

DETAILED DESCRIPTION OF PREFERRED EMBODIMENT

Figure 1:
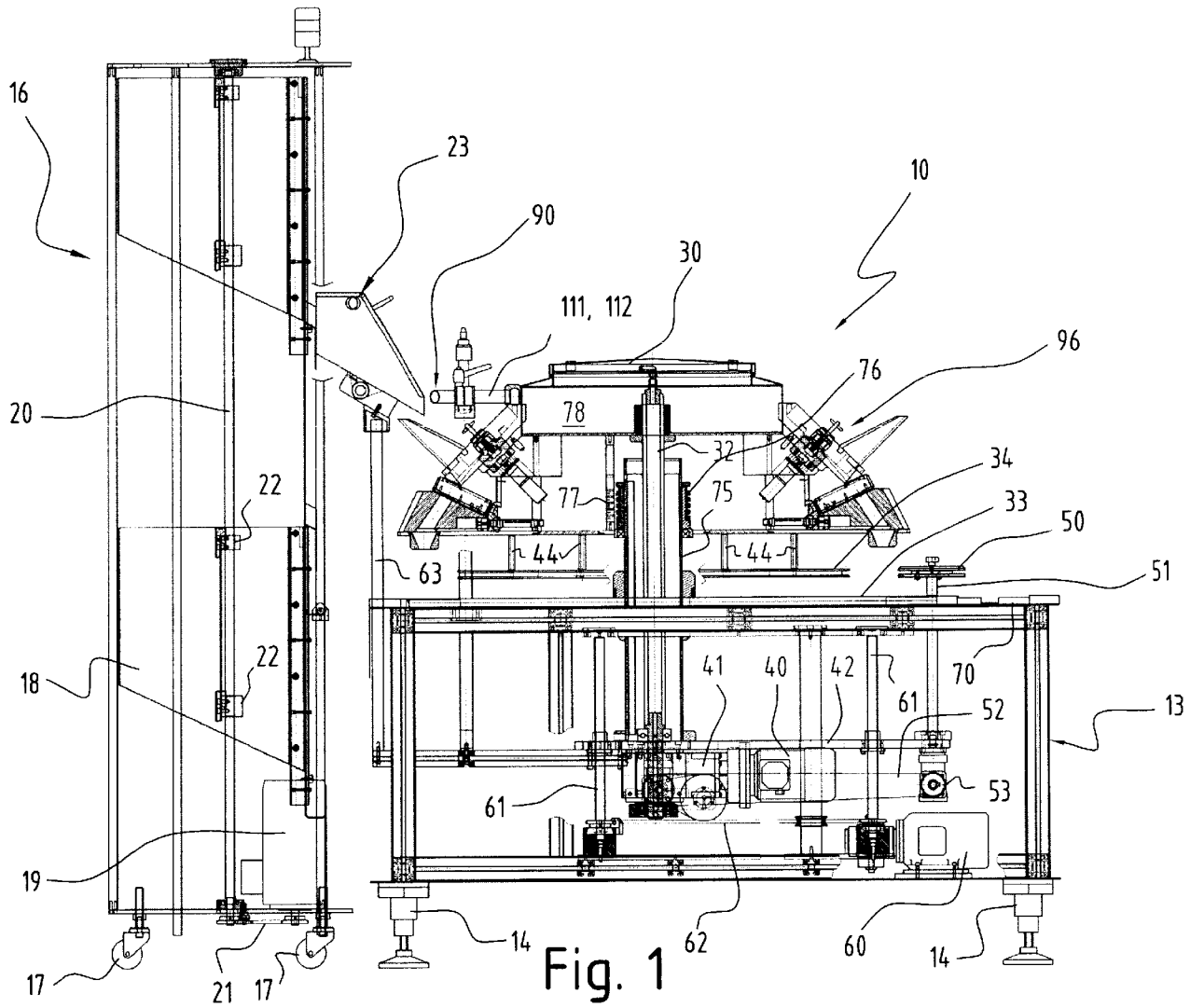
FIG. 1 is an elevational view of a filling apparatus according to an embodiment of the invention shown with the housing removed.
Figure 3:
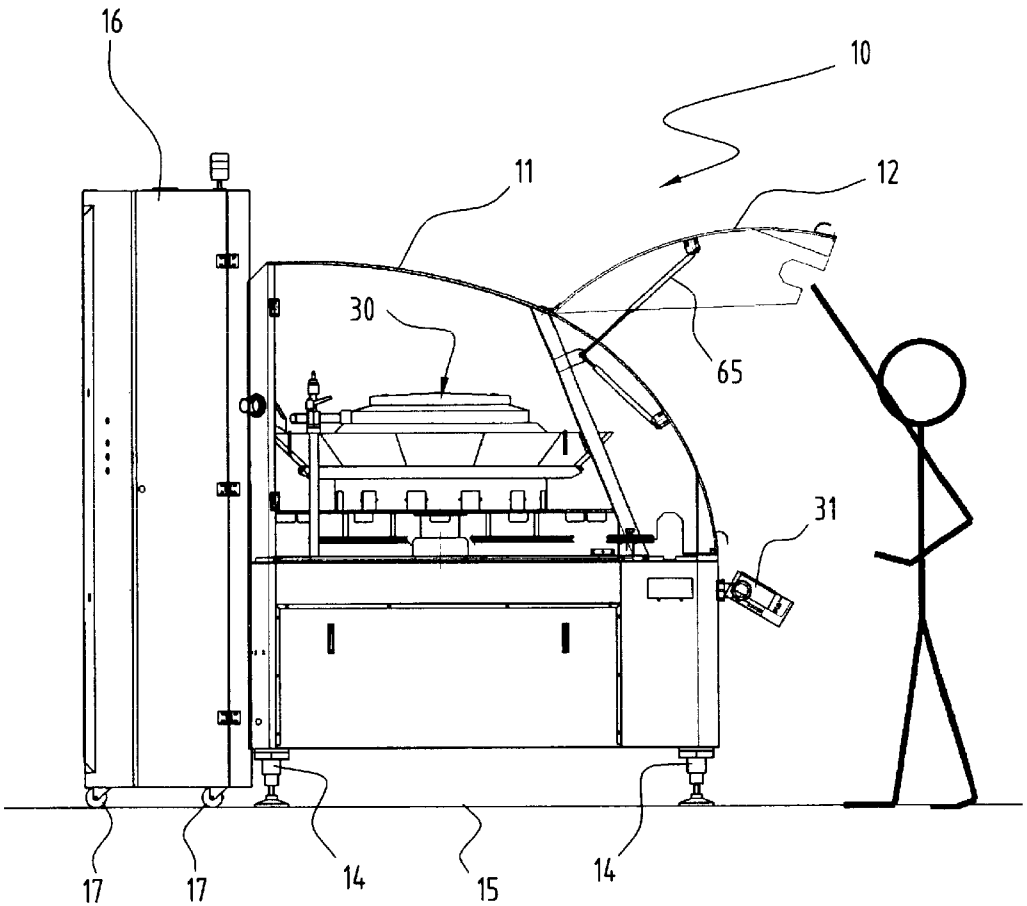
FIG. 3 is a side elevational view of the apparatus shown in FIG. 2.
Figure 2:
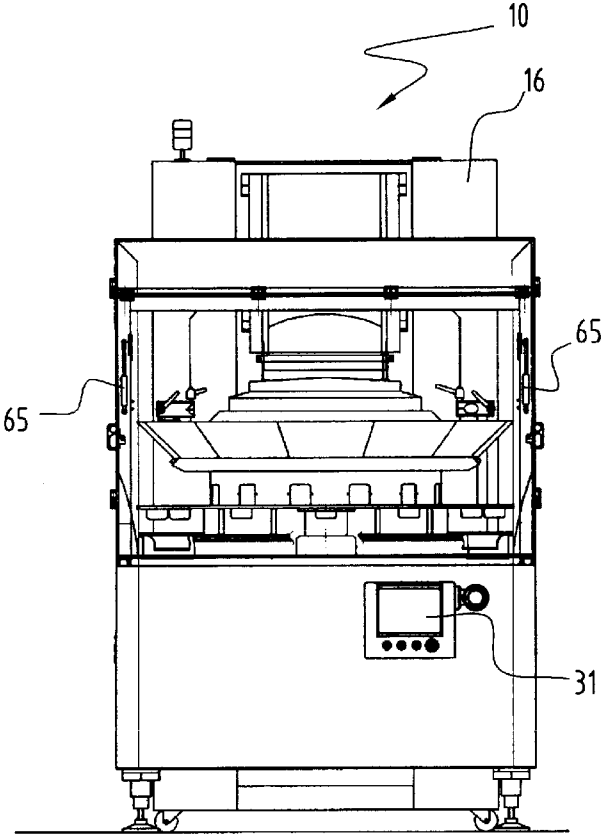
FIG. 2 is a front elevational view of the apparatus with the housing in position.

FIG. 1 shows the apparatus 10 without a housing whilst FIGS. 2 and 3 show the apparatus 10 with a housing. The housing 11 has a door 12 shown in its open position in FIG. 3. The door 12 shown in FIG. 3 is supported by struts 65 which serve to maintain the door in a raised position when the door is opened.

The apparatus 10 has a frame 13 terminating in adjustable legs 14. The legs 14 normally rest upon ground 15 and allow the apparatus 10 to be levelled relative to the ground 15. An elevator housing 16 is located adjacent to the apparatus 10. The elevator housing 16 rests upon wheels 17. The housing 16 contains a bin 18 for tablets or other discrete articles. In FIG. 1 the bin 18 is shown twice; once in its lowered position and a second time in its raised position. The elevator housing of course contains only one bin 18. The housing 16 has a door (not shown) present on that side opposed to housing 11. The door may be opened and when the bin is in its lowered position tablets or other discrete articles may be deposited into the bin 18.

Motor 19 is coupled to lead screws 20 arranged on opposite sides within the housing by drive members 21. The bin 18 is connected to the lead screws by followers 22. Operation of the motor 19 causes the bin 18 to be driven between its two positions.

When the bin 18 is in its raised position tables may be dispersed from the bin 18 over delivery chute 23 and onto the filling head 30.

The apparatus 10 has a control console 31. The filling head 30 is mounted for rotation with the shaft 32 and the head 30 may be raised and lowered with respect to platform or table 33. The filling head 30 includes a plurality of circumferentially spaced metering stations described in greater detail below. The head has a container carousel 34 mounted to it such that when the head is rotated the carousel rotates with the head. Likewise, when the head is raised or lowered, the carousel 34 is also raised or lowered. By moving the carousel in the vertical direction the spacing between the carousel and the platform 33 may be varied to allow the apparatus 20 to accommodate containers of a variety of sizes.

Motor 40 is coupled to a gearbox 41 and both are mounted to a support 42. The gearbox 41 is coupled to shaft 32 and functions to rotate the filling head 30 and the container carousel 34 coupled to the head by stays 44.

An infeed carousel 50 is mounted to shaft 51. Shaft 51 is driven by drive member 52 which extends between the gearbox 41 and a coupling 53. Thus, infeed carousel 50 and container carousel 34 are driven in synchronism. When the head 30 and hence carousel 34 are moved vertically, carousel 50 is correspondingly moved vertically.

Motor 60 is coupled to lead screws 61 which extend through support 42 and when the screws 61 (there are three in number but only two are visible in FIG. 1) are caused to rotate and the head and carousel 50 are moved in unison in the vertical direction. A drive member 62 extends between the lead screws 61. The shute 23 is mounted at the end of a support 63 which has its lower end connected to the support 42. When the support 42 is moved vertically the shute 23 is likewise moved in the vertical direction.

A container conveyor 70 extends across the apparatus and serves to convey empty containers to the apparatus and convey filled containers from the apparatus.

The shaft 32 is located within an outer sleeve 75 and slip rings 76 extend around the sleeve 75. Brushes 77 are mounted relative to the head 30 and allow electrical supply and control signals to be coupled to the head. Control circuitry may be located within housing 78 carried by the head and the apparatus is controlled by console 31. The space between the shaft 32 and the sleeve 75 may be supplied with compressed air which is made available to operate pneumatic operators associated with the metering stations.

Figure 4:
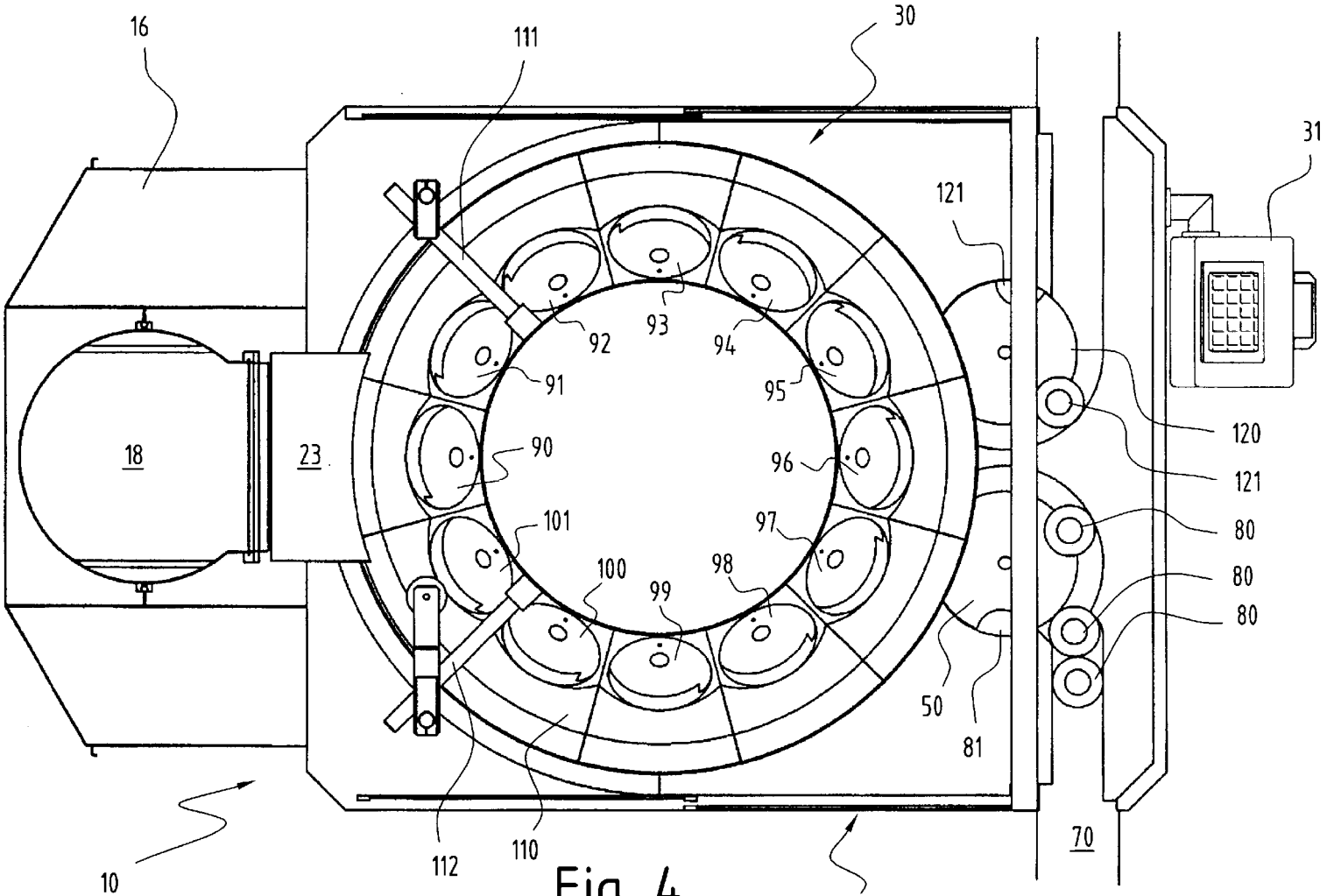
FIG. 4 is a plan view of the apparatus of an embodiment of the invention.

FIG. 4 is a plan view of the apparatus 10 of the invention. A container conveyor is shown extending across the apparatus 10. Empty containers 80 are presented by the conveyor 70 to the infeed carousel 50. Carousel 50 has a container receiving recesses 81 circumferentially spaced around its peripherary and empty containers 80 are picked up by the carousel 50 as the carousel rotates in an anti clockwise direction and presents those containers to the container carousel 34 (see FIGS. 1 and 8) which rotates with the head 30. The head 30 rotates in a clockwise direction.

The head has a plurality of metering stations 90 to 101 arranged circumferentially spaced around the head 30. An outwardly and upwardly flared skirt 110 extends around the head and ensures that tablets delivered by shute 23 are directed towards the metering stations. Two vacuum lines 111, 112 allow debris to be removed from the stations 90 to 101 in a manner described below.

An outfeed carousel 120 receives filled containers 121 from the head 30 and presents them to the conveyor 70 so that they may be transported from the apparatus. Carousel 120 although not visible in FIG. 1 is mounted on a shaft like shaft 51 and is driven by gearbox 41 in a like manner to the way in which shaft 51 is driven. Carousel 120 is vertically movable in unison with the vertical movement of carousel 50 and is vertically movable in a similar way to which carousel 50 is vertically movable. Carousel 120 has container receiving recesses 121 circumferentially spaced around it for receiving containers. When the head is rotated in a clockwise fashion the carousels 50 and 120 both rotate in an anticlockwise direction. In this way, the apparatus 10 functions such that the conveyor 70 moves in a direction from the lower part of FIG. 4 to the upper part of the figure. Of course the conveyor may be moved in the reverse direction and in which case carousels 120 and 50 would then be rotated in a clockwise direction and the container carousel 34 would be rotated in an anticlockwise direction. Empty containers would be introduced by the conveyor 70 from the upper part of the figure as viewed in FIG. 4 and filled containers would be available on the conveyor 70 at the lower part of the figure as viewed in FIG. 4.

Figure 5B:
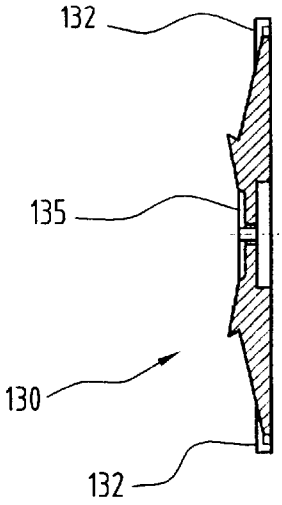
FIGS. 5*a* and *b* are front and side views of a sorting wheel according to an embodiment of the invention.
Figure 5A:
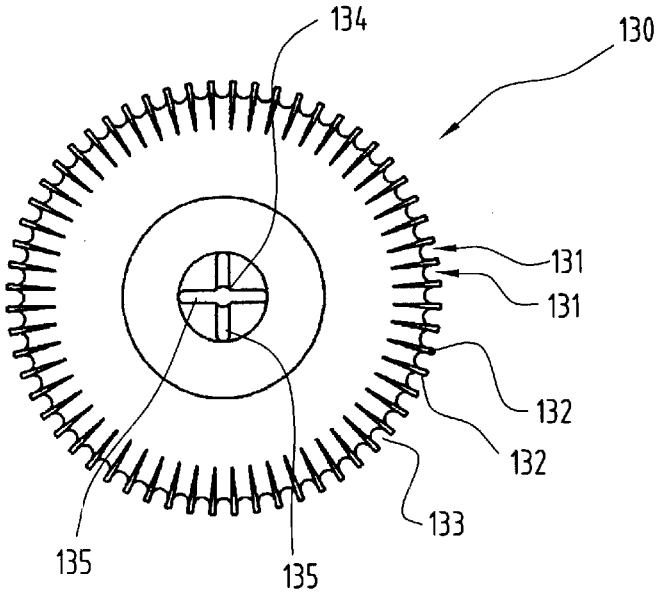

FIGS. 5*a* and 5*b* show details of a sorting wheel 130. Such a wheel is present in each metering station and is mounted for rotation in the station. The wheel 130 has an outer periphery with a plurality of circumferentially spaced tablet receiving passages 131. Each passage 131 functions to pick up a single tablet as the wheel rotates. The passages 131 are defined by spaced webs 132 which extend slightly beyond the periphery of the wheel to define a tablet delivery opening 133 between the webs 132 and slightly beyond the periphery of the wheel.

The wheel 130 has a central aperture 134 for receiving a drive shaft which terminates in a locking extension extending across the shaft. The diametrically extending slots 135 are adapted to receive the locking extension.

One of these slots is shallow and the owner extends completely through the wheel. FIG. 5*b* shows a diametrical sectional view across the sorting wheel 130.

Figure 6A:
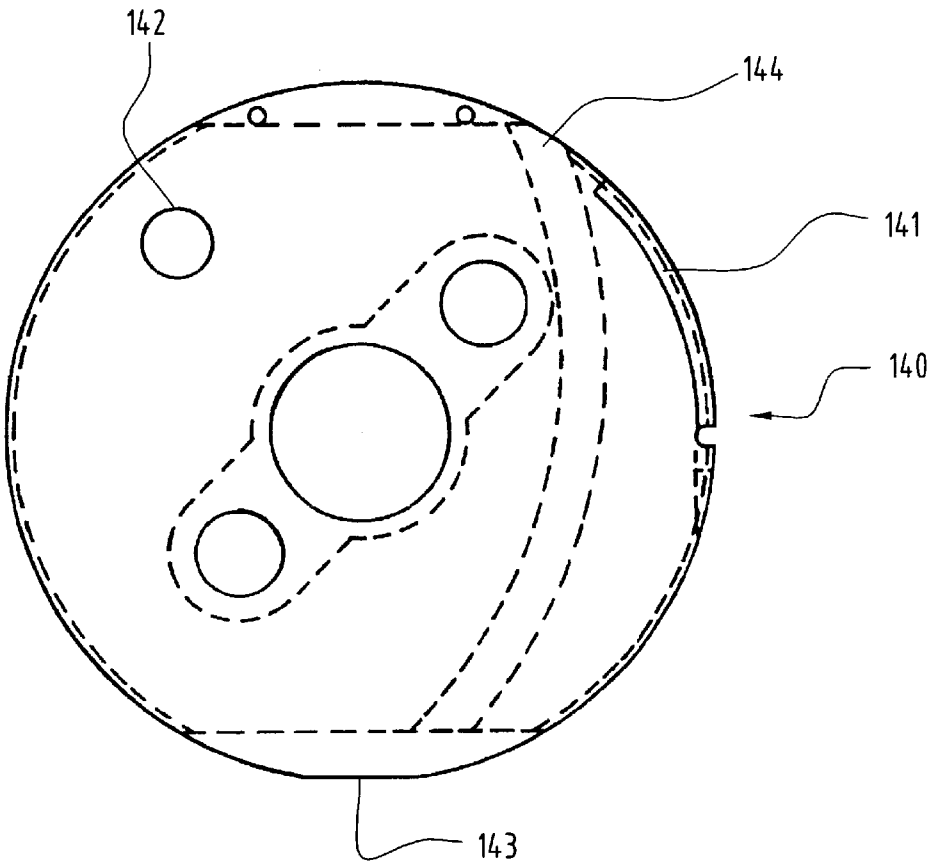
FIGS. 6*a* and *b* are front and side views of a backing plate to which the sorting wheel of FIGS. 5*a* and *b* may be mounted.
Figure 6B:
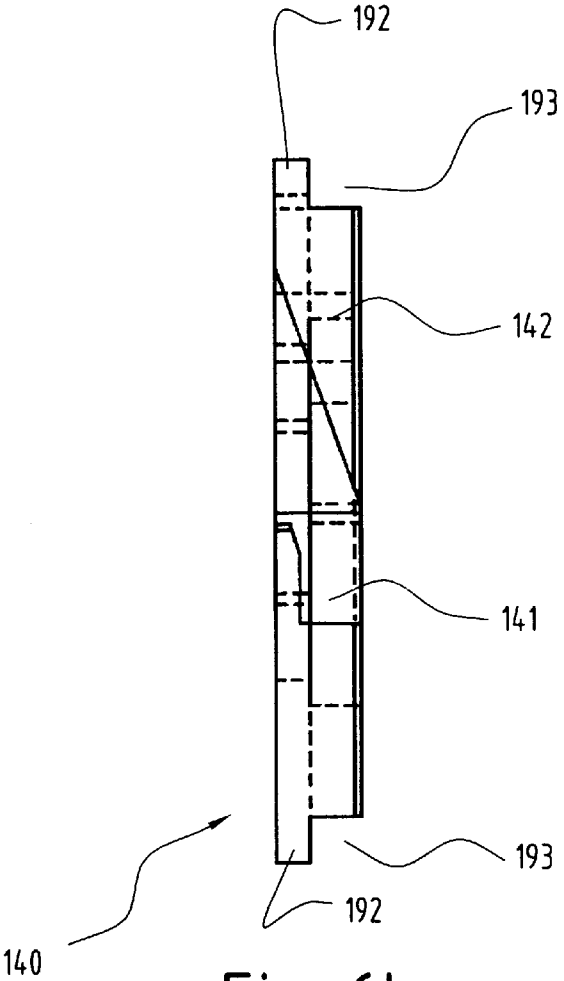

FIGS. 6*a* and 6*b* show views of a backing plate 140. In use, the backing plates are located within the metering stations and are fixed against rotation. A sorting wheel like that described in relation to FIGS. 5*a* and 5*b* is located above each backing plate and in use rotates relative to the plate.

The plate 140 has a delivery port 141 which extends from one face of the plate to the other face. A registry opening 142 extends through the plate and receives a registry pin 150 (see FIG. 7) which extends outwardly from a face of each metering station.

Plate 140 has a flat portion 143 at one location on its periphery. This portion 143 provides a degree of clearance between the plate 140 and face 151 of the metering station to allow for vacuum extraction of debris from the metering station. A debris extraction passage extends across a rear face of plate 140.

Figure 7:
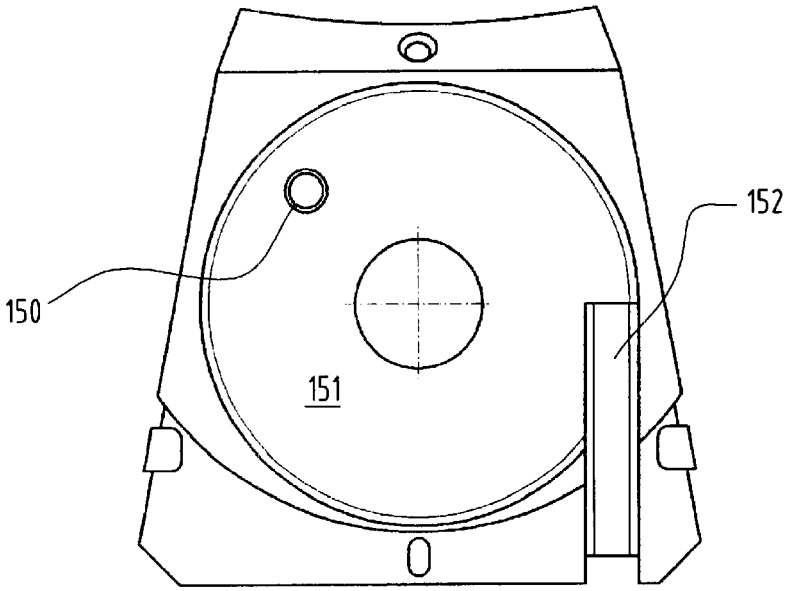
FIG. 7 is a view into a metering station of the invention with the sorting wheel and backing plate removed from the station.

FIG. 7 is a view into a metering station with the wheel 130 and plate 140 removed. The station has a delivery passage 152 at one side thereof. As the wheel 130 rotates a tablet may be presented to port 141 of plate 140 and may then pass in a controlled manner through passage 152.

Figure 8:
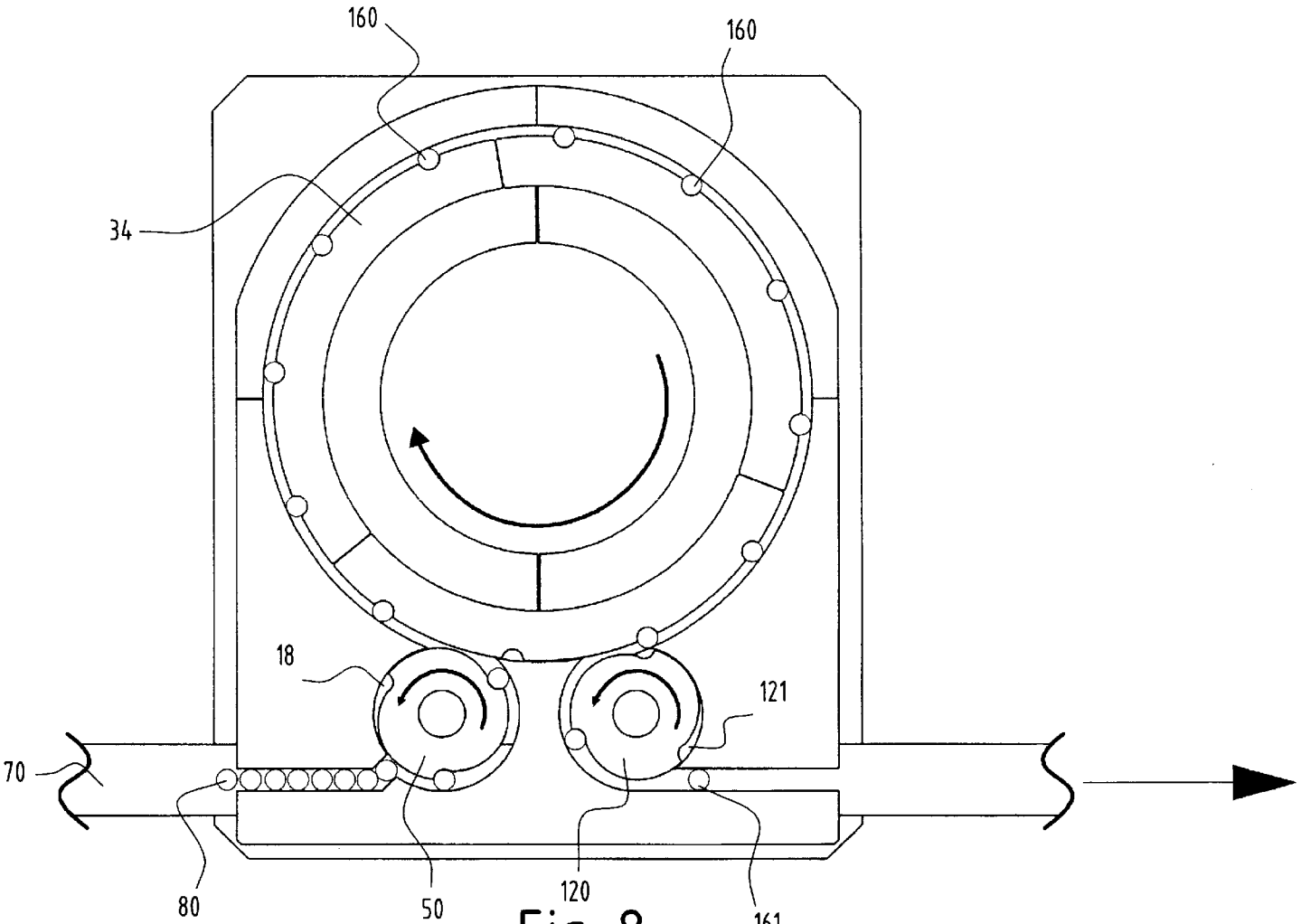
FIG. 8 is a partial plan view of the apparatus with the filling head removed.

FIG. 8 is a view similar to the view shown in FIG. 4 but with some parts of the apparatus removed to show further details. FIG. 8 shows the carousels 50 and 120 with their respective container receiving recesses 81 and 121. Container carousel 34 has container receiving recesses 160 which, with the rotation directions shown in the figure, receive empty containers 80 from carousel 50, convey the containers towards carousel 121 whilst the containers are being filled and present filled containers 161 to carousel 120.

Figure 9:
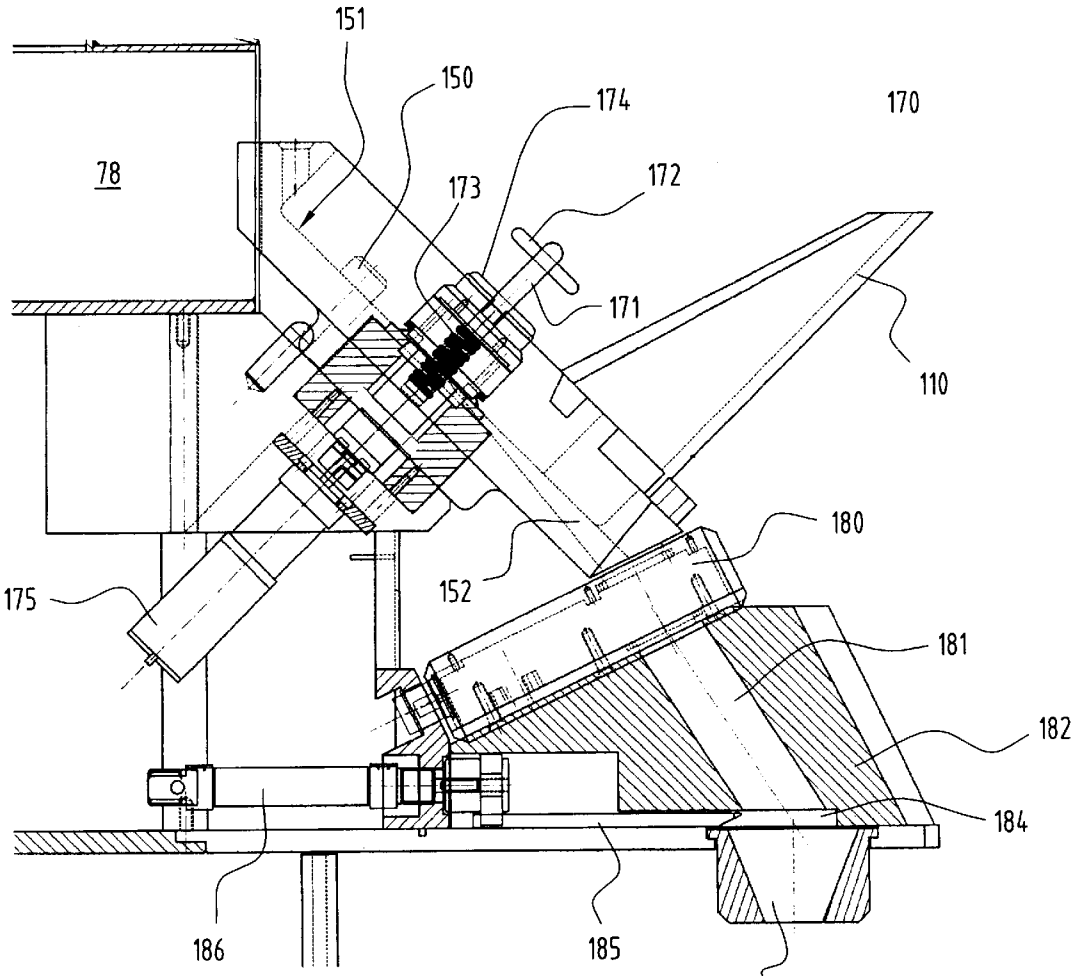
FIG. 9 is a partial sectional view through one of the metering stations.

FIG. 9 shows detail of a metering station 170. The sorting wheel and plate of FIGS. 5 and 6 have been omitted from this view. Part of the skirt 110 which extends around the metering stations is visible in this view. Spring biased locking shaft 171 extends outwardly from the station. Handle 172 may be grasped to allow the shaft 171 to be partially withdrawn from the station against the action of the spring 173,. The shaft 171 may be rotated through 90° to rotate locking bar 174 to allow one of the slots 135 in the wheel (see FIG. 5) to align with the bar 174 to allow the wheel to be removed. One of the slots extends right through the wheel whilst the other is relatively shallow like shown in FIG. 5*b*. Bar 174 locates in the shallow slot 135 to lock the wheel 130 in position in the station 170 after plate 140 (in FIG. 6) has been positioned with pin 150 being received in aperture 142. Motor 175 is able to rotate shaft 171 and hence rotates the wheel 130 normally received in the metering station. Tablets dispensed by the wheel progress through port 141 (see FIG. 6), through passage 152, through a counting head 180 and through passage 181 in mounting block 182 and out through outlet opening 183 and into a container to be filled normally located below outlet 183.

The counting head 180 carries optical sensors which detect and count the number of tablets passing from passage 152 and to passage 181. Block 182 has a recess 184 which receives a gate 185. The gate is movable by a pneumatically driven cylinder assembly 186 from the open position shown, to a closed position once a desired tablet count has been received from the head 180 to prevent further tablets from exiting through the outlet. Once the desired count has been obtained the motor 175 is controlled to stop rotation of the wheel 130.

Figure 11:
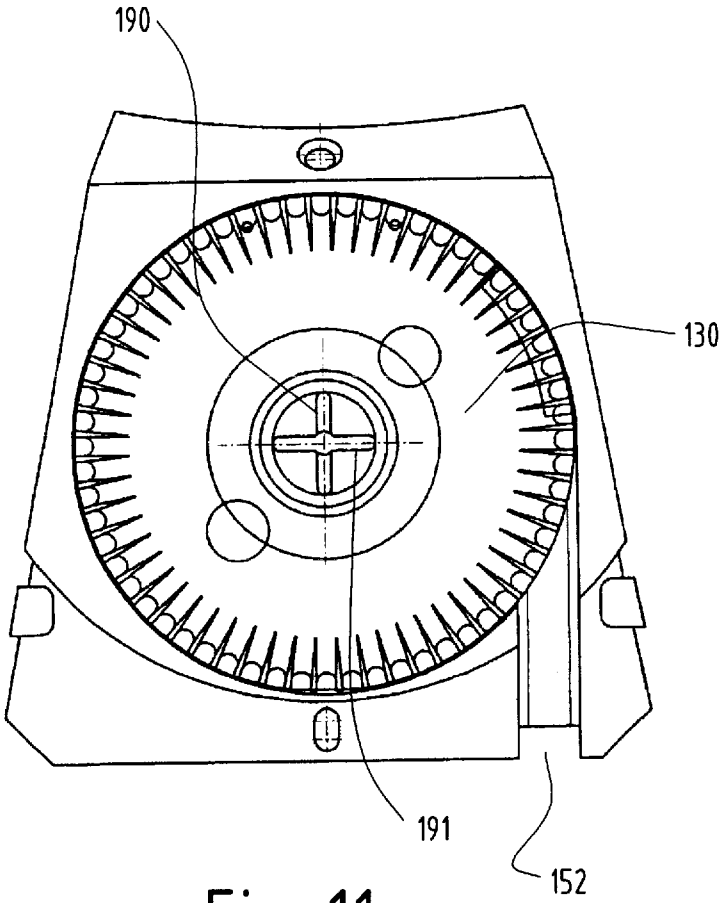
FIG. 11 is a front view of the metering station shown in FIG. 10.
Figure 10:
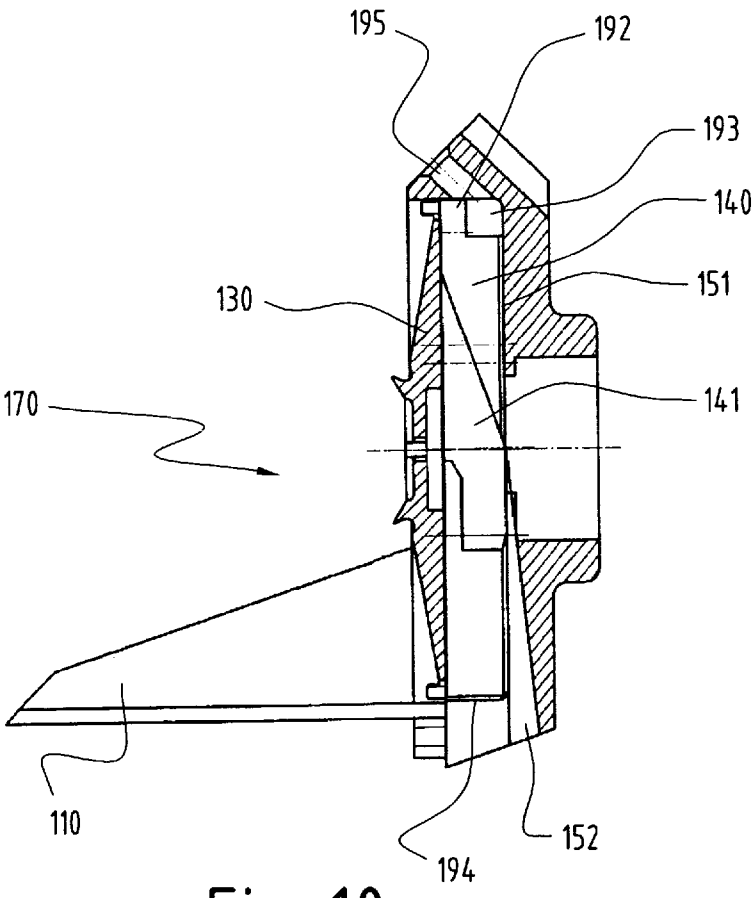
FIG. 10 is a partial sectional view of part of a metering station.

FIGS. 10 and 11 show metering station 170 with the wheel 130 and plate 140 in position. The wheel 130 has a shallow locking slot 190 for receiving locking bar 174 (see FIG. 9) and a through slot 191 through which the bar 174 may pass to allow the wheel 130 to be removed from the station. The plate 140 has a stepped portions 192 provide cavities 193. The flat portion 143 (see FIG. 6*a*) on the plate 140 provides clearance 194 between the plate and an adjacent part of stations. Debris extraction passage 144 extends from the upper cavity 193 to the lower cavity 193. Port 195 allows a source of vacuum to be coupled to the station and any debris which may collect in the station may be removed from the station by vacuum and the debris May be withdrawn from the spaces provided by the clearance and the cavity 193.

What is claimed is:

1. An apparatus for filling containers with a predetermined number of discrete articles, the apparatus having a container conveyor for transporting containers to be filled to the apparatus and for transporting filled containers from the apparatus, a rotatable filling head positioned adjacent the container conveyor the filling head having a plurality of circumferentially spaced metering stations each for metering and dispensing a stream of a predetermined number of discrete articles into a container in a continuous manner as the head rotates, each said metering station including an article delivery passage, a backing plate with a delivery port extending therethrough and communicating with the delivery passage and a sorting wheel positioned against the plate and mounted for rotation relative to the plate for delivering the articles to the delivery port as the wheel rotates, a container carousel having a plurality of container receiving zones and mounted for rotation with the head, whereby a plurality of containers are filled in unison by the head as the carousel moves the containers in synchronism with the head and filled containers are presented to the conveyor by the carousel and conveyed away from the filling head.

2. The apparatus of claim 1 including a platform on which the containers may rest whilst being filled and the head and the carousel being movable towards and away from the platform.

3. The apparatus of claim 2 including an infeed carousel for receiving containers from the conveyor and for presenting the containers to the container carousel.

4. The apparatus of claim 3 including an outfeed carousel for receiving containers from the container carousel and for presenting them to the container conveyor.

5. The apparatus of claim 4 wherein the infeed and the outfeed carousel are movable towards and away from the platform together with the head and container carousel.

6. The apparatus of claim 5 including a drive for rotating the head and the carousels.

7. The apparatus of claim 5 including a drive for moving the head and the carousels towards and away from the platform.

8. The apparatus of claim 1 including a skirt extending around the head for directing the articles towards the metering stations.

9. The apparatus of claim 1 wherein the metering station includes a counting block having an article sensor for counting the number of articles passing through the delivery port of the plate.

10. The apparatus of claim 9 wherein each said metering station includes controllable gate operable by the sensor to stop the flow of articles from the station once a predetermined count is reached.

11. The apparatus of claim 9 wherein once a predetermined article count is reached rotation of the sorting wheel is stopped.

12. The apparatus of claim 10 wherein the gate is slidably movable by an actuator between an open position allowing articles to flow from the delivery passage to a closed position preventing the flow of articles from the delivery passage.

13. The apparatus of claim 1 wherein each said sorting wheel has a plurality of circumferentially spaced article receiving passages defined by spaced webs.

14. The apparatus of claim 13 wherein the webs extend beyond a periphery of the wheel to provide an article delivery opening between adjacent said webs and beyond the periphery of the wheel.

15. The apparatus of claim 1 wherein the backing plate has a stepped upper and lower portion at a periphery thereof and a clearance providing flat portion at a diametrically opposed location on the periphery and a debris extraction passage extends between the upper and lower stepped portions.

16. The apparatus of claim 15 wherein the delivery port is positioned between the stepped upper portion and the flat clearance providing portion and to one side of the plate.

17. The apparatus of claim 1 including an article elevator adjacent the filling head for supplying articles to the metering stations.

18. The apparatus of claim 17 wherein the elevator includes an article bin mounted for movement between a lowered bin filling position and a raised portion at which articles within the bin may be supplied to the metering stations.

* * * * *